United States Patent [19]

Hargett

[11] 4,393,800

[45] Jul. 19, 1983

[54] BELT LOOP FOLDER AND FEED APPARATUS

[75] Inventor: Francis B. Hargett, Richmond, Va.

[73] Assignee: AMF Incorporated, White Plains, N.Y.

[21] Appl. No.: 300,769

[22] Filed: Sep. 10, 1981

[51] Int. Cl.[3] ..... D05B 3/12

[52] U.S. Cl. ..... 112/265.1; 112/104; 112/121.27; 112/262.3

[58] Field of Search ..... 112/104, 121.27, 121.26, 112/113, 114, 265.1, 262.1, 262.3

[56] References Cited

U.S. PATENT DOCUMENTS

| | | | |
|---|---|---|---|
| 3,699,907 | 10/1972 | Anderson et al. | 112/121.27 |
| 3,841,247 | 10/1974 | Off et al. | 112/104 X |
| 4,114,544 | 9/1978 | Miyachi et al. | 112/104 |
| 4,137,856 | 2/1979 | Brauns et al. | 112/104 |
| 4,137,857 | 2/1979 | Miyachi et al. | 112/121.27 |
| 4,279,209 | 7/1981 | Diacont, Jr. | 112/104 |

*Primary Examiner*—H. Hampton Hunter

*Attorney, Agent, or Firm*—David E. Dougherty; Charles J. Worth

[57] ABSTRACT

A loop folder and feed apparatus for a drop belt loop tacker comprising means for folding both ends of the belt loop with the folded upper end extending past the fold of the lower end to provide an exposed tab or flag to be sewn, stabilizer means for clamping the loop during folding and the folded loop being clamped by the folding means while being presented to the stitching station of the tacker.

10 Claims, 8 Drawing Figures

BELT LOOP FOLDER AND FEED APPARATUS

This invention relates generally to tack type sewing machines for attaching belt loops to garments and more particularly to the method and apparatus associated with such machines for folding and feeding folded belt loops to the stitching station.

Belt loops are normally sewn to garments in two ways, both being difficult and time consuming. Belt loops sewn on casual or work clothes, such as dungarees or jeans have both ends folded under with visible stitching through both folded ends. Dress, and more formal clothing, have drop type belt loops wherein the upper end is stitched to the garment and the loop is folded over covering the stitched end. The other or bottom end of the loop is folded under and sewn to the garment with visible stitching through the folded end. The present invention is directed to stitching such drop loops.

Belt loops may be made as a ribbon-like preform stored on a spool for future use by cutting the ribbon into discrete lengths, the desired lengths of the loops to be stitched to a garment. Alternatively, belt loops may be made at the time they are stitched or tacked on to the garments.

The present invention is particularly adapted to fold and present the folded belt loops to means operatively associated with a stitching machine for tacking drop loop type belt loops to garments. An example of such apparatus is disclosed in U.S. Pat. No. 4,279,209 granted July 21, 1981 to G. P. Diacont, Jr., and assigned to the assignee of the present application.

An object of the present invention is to provide an improved method and automatic apparatus for folding and delivering prefolded belt loops for attachment to a garment.

Another object of the present invention is to provide the foregoing method and apparatus which permits the machine operator to simultaneously position the garment to which such a belt loop is to be attached while the belt loop is being folded and delivered.

Still another object of the present invention is to provide the foregoing apparatus which continuously grips and holds the belt loop from reception to delivery of the prefolded belt loop.

And still another object of the present invention is to provide an improved method and automatic apparatus to facilitate and reduce the operating time for attaching drop type belt loops to garments.

The foregoing and other objects will appear more fully hereinafter from a consideration of the detailed description which follows, taken together with the accompanying drawings wherein a single embodiment of the invention is illustrated by way of example. It is to be expressly understood, however, that the drawings are for illustration purposes only and are not to be construed as defining the limits of the invention.

In the following description, the left and right sides of the apparatus will be considered to be the apparatus sides located at the left and right sides of the drawings.

Figure 1:
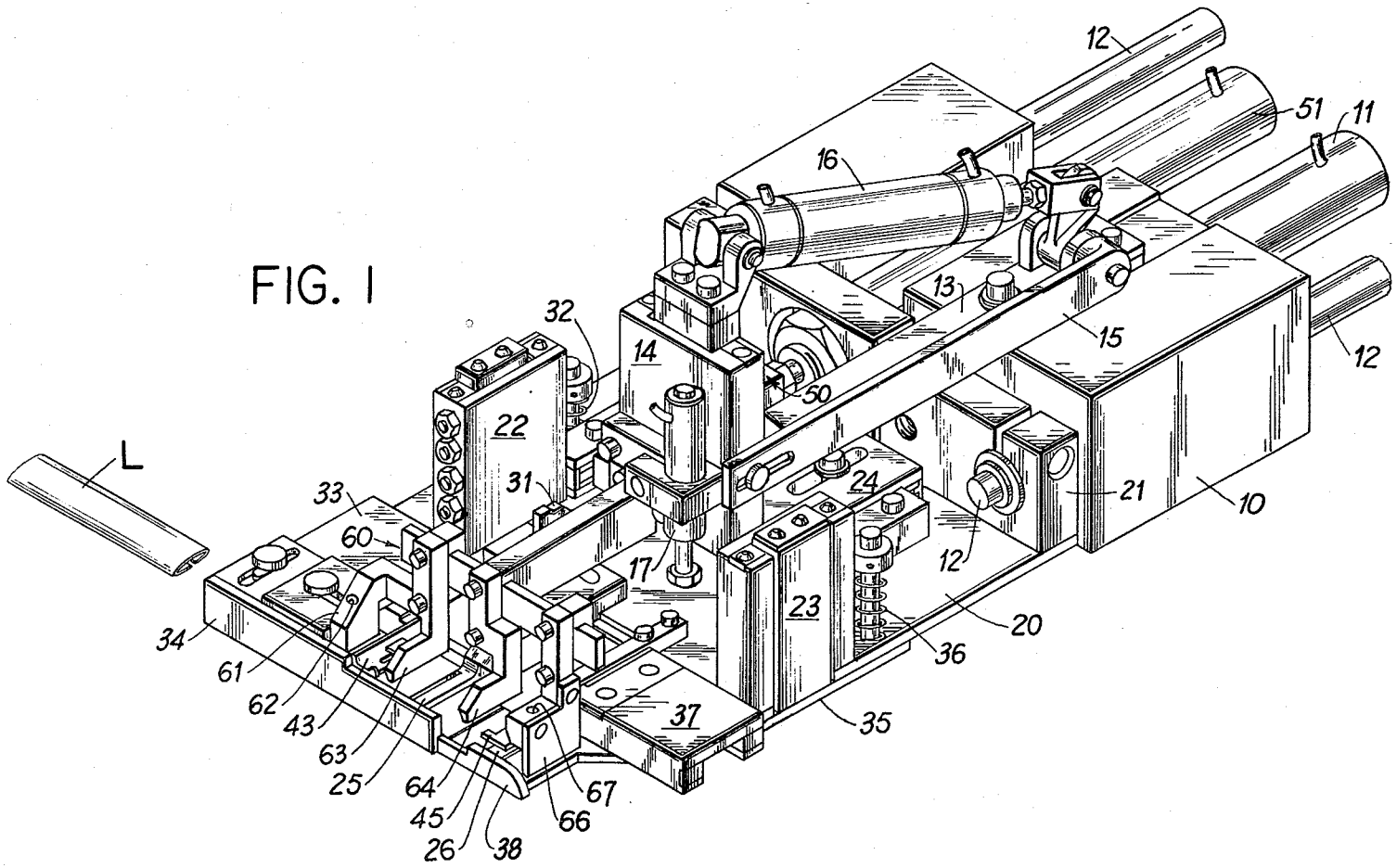
FIG. 1 is a perspective view of the novel belt loop folding and feeding apparatus made in accordance with the present invention.
Figure 2:
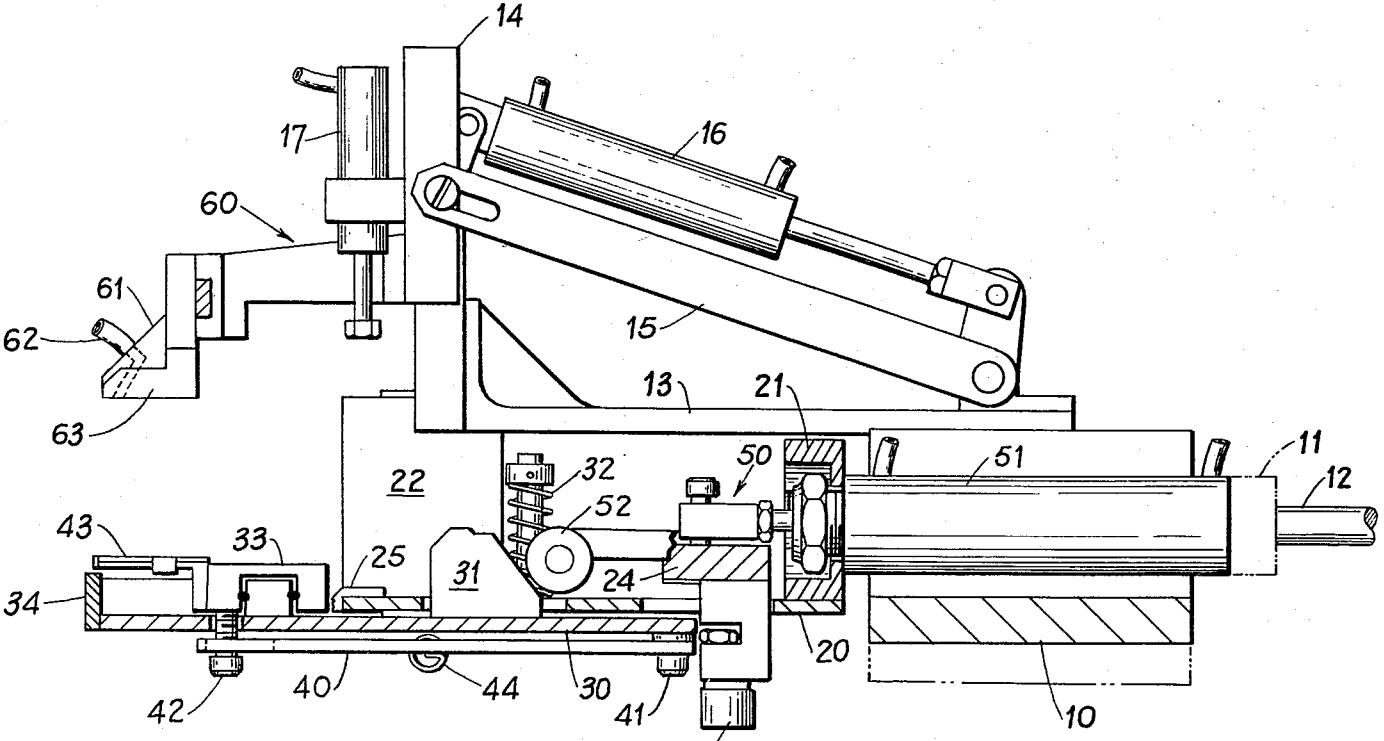
FIG. 2 is a side elevational view of the apparatus of FIG. 1 with the loop stabilizing means in its elevated position prior to delivery of a belt loop and parts broken away to illustrate the cam operating means for the loop folding tongues.

Referring now to the drawings, and particularly to FIGS. 1 and 2, the novel belt loop fold and feed apparatus in accordance with the present application is provided with a bearing block 10 which is mounted in an appropriate relative position to the stitching station of a tacker type sewing machine as shown in U.S. Pat. No. 4,279,209. As will be fully understood, a belt loop will be received and positioned by the novel apparatus which will properly fold the loop and thereafter move the loop forwardly from the bearing block 10 to the stitching station of a tacker type machine, for example, the aforenoted patent.

The basic structure movable toward and away from such a stitching station is comprised of a base plate 20 having a rear wall or flange 21 to which are connected the forward ends of a double acting axial fluid motor 11 mounted on the bearing block 10 and a pair of thrust rods 12 movable axially in the bearing block and disposed on opposite sides of the motor 11. A bracket 13 is mounted at its rear end on the bearing block 10 and extends forwardly therefrom providing a vertical slide assembly 14 at its forward end.

A bell crank 15 is pivotally connected at the rear end of the bracket 13 and has an arm forming a radius rod pivotally connected at its front end to the movable portion of the slide 14. A double acting axial fluid motor 16 has its cylinder end pivotally connected to the fixed portion of the slide 14 and its piston end pivotally connected to the other arm of bell crank 15. When the motor 16 is retracted, the movable part of slide 14 is in its lower position with a spring biased single acting axial fluid motor forming a stop 17 mounted on the front of the slide contacting the top surface of the main or base plate 20 as shown in FIG. 1. When the motor 16 is extended, the bell crank 15 is rotated causing the movable portion of slide 14 to move the upper portion as shown in FIG. 2.

The forward end of the main or base plate 20 is provided with a pair of vertical slide assemblies 22 and 23, and a centrally located horizontal slide assembly 24 disposed just forward of the rear wall 21, the movable portion thereof being movable along a longitudinal axis. The fixed portions of the slide assemblies are connected to the base plate 20 while a left drop plate 30 is connected to the movable part of slide assembly 22, a right drop plate 35 is connected to the movable part of slide assembly 23 and a cam assembly 50 is connected to the movable member of slide assembly 24.

The drop plate 30, disposed below the left side of the base or main plate 20, is provided with a cam block 31 extending upwardly through the base plate, and spring means 32 biasing the drop plate 30 upwardly toward the base plate 20. The drop plate 35 is similarly provided with a cam block (not shown) and spring means 36 corresponding to the cam block 31 and spring means 32, respectively.

Figure 3:
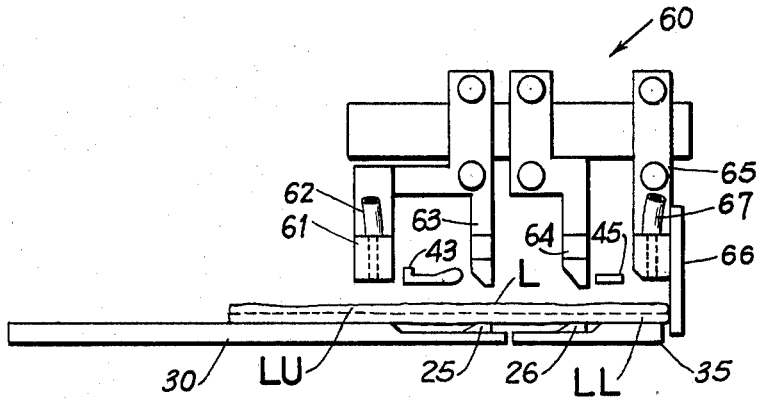
FIG. 3 is a fragmentary front elevational view with the front guide rail removed to illustrate a belt loop in the receiver of the novel apparatus.

The drop plates 30 and 35, immediately forward of the main or base plate 20, are provided with horizontally disposed laterally movable slide assemblies 33 and 37, respectively, and with respective front walls or plates 34 and 38 and their front edges spaced from the slide assemblies 33 and 37. The slide assemblies 33 and 37 with front walls 34 and 38 together with the forward portions of the drop plates 30 and 35 cooperate with an end stop 66 to define a receiver for belt loops L to be folded. A pair of laterally spaced stationary folding tongues 25 and 26 are connected to the front end of the main or base plate 20 and extend forward therefrom across the defined belt loop receiver and, in the initial or loop receiving position of the apparatus, are disposed in recesses in the upper surfaces of the drop plates 30 and 35, respectively, as best shown in FIG. 3. The lateral space between the stationary tongues 25 and 26 may be adjusted to accomodate belt loops of different lengths.

A left cam arm 40, biased outwardy to the left by a spring 44, is connected at its back end by a pivot 41 to the bottom of the left drop plate 30 and at its front end by a pivot 42 to the movable portion of the slide 33. A movable folding tongue 43, mounted on the movable portion of slide 33, extends forwardly across the defined belt loop receiver and in the initial or belt loop receiving position is spaced above and outwardly to the left of the stationary folding tongue 25, as best shown in FIG. 3.

Similarly, a right cam arm (not shown), biased outwardly to the right, corresponding to arm 40, is connected at its back end to drop plate 35 and its front end to the movable portion of slide 37 by pivots (not shown) corresponding to pivots 41 and 42, respectively. A movable folding tongue 45, spaced laterally from the tongue 43 and mounted on the movable portion of slide 37, extends forwardly across the defined belt loop receiver and in the initial or belt loop receiving position is spaced above and outwardly to the right of the stationary folding tongue 26, as best shown in FIG. 3.

Figure 6:
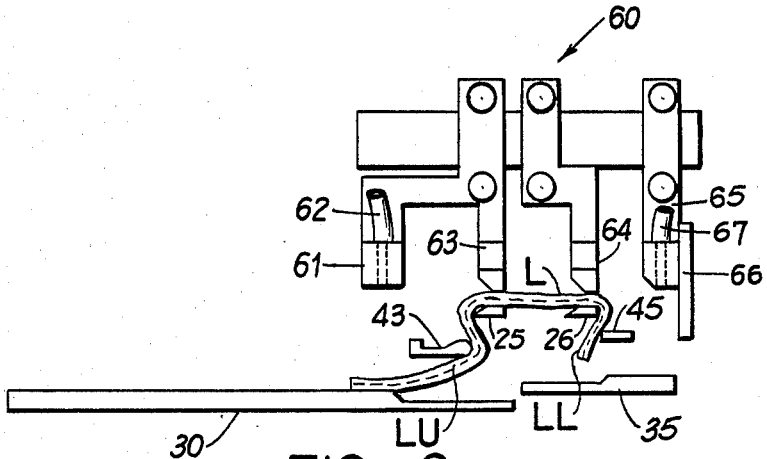
Figure 7:
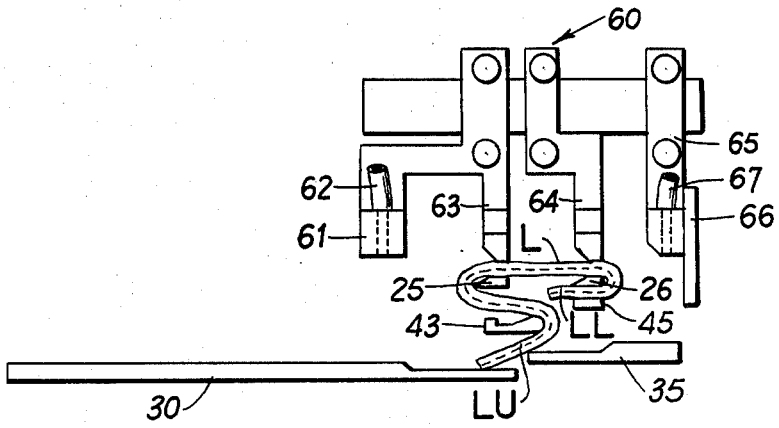
Figure 8:
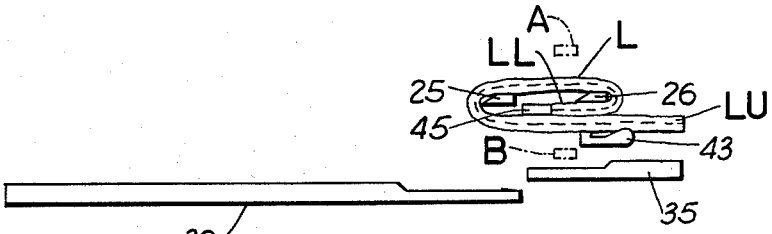
FIG. 8 is a fragmentary front elevational view of a folded loop clamped by the fixed and movable tongues being delivered to a stitching station.

The cam assembly 50, connected to the movable portion of the slide 24, is moved in a longitudinal direction (forwardly and rearwardly) by the double acting axial fluid motor 51 and is provided with horizontal roller cams 52 (only one shown) which on initial forward movement of the assembly engage the cam block 31 and the cam block (not shown) corresponding thereto causing the plates 30 and 35 with cam arm 40 and the cam arm (not shown) corresponding thereto to move downwardly against the bias of springs 32 and 36. This movement causes the movable folding tongues 43 and 45 to move downwardly below the stationary folding tongues 25 and 26, as shown in FIG. 6. Further movement of the cam assembly 50 will cause its vertical cams 53 (only one shown) to engage and move the cam arm 40 and the cam arm (not shown) to move toward each other which progressively moves the movable folding tongues 43 and 45 laterally as shown in FIGS. 6, 7 and 8 for folding a belt loop L.

All of the apparatus described above connected directly or indirectly to the main or base plate 20 from the belt loop folding and feeding means which moves forwardly to the stitching station as will be further described.

A stabilizer assembly 60 is mounted on the movable portion of the slide 14 and extends forwardly therefrom terminating with four laterally spaced fingers or jaws 61, 63, 64 and 65 having bottom surfaces or faces disposed in a common horizontal plane and being adjustable laterally to vary the spacing therebetween to accomodate belt loops of various sizes. The finger 61 has means 62 for providing an air jet to impinge on a belt loop in the defined receiver urging the loop forwardly against the wall 34. The finger 65 to which is connected the end stop plate 66 has means 67 to provide an air jet which impinges on a belt loop in the receiver urging the loop forwardly against the wall 38 and to the right against the stop 66. The jaws 63 and 64 are vertically aligned with the stationary folder tongues 25 and 26, respectively. The fingers or jaws 61, 63 64 and 65 extend parallel to each other across the defined belt loop receiver and in the initial or belt loop receiving position are spaced above the drop plates 30 and 35 preferably with their bottom surfaces substantially in the same horizontal plane as the movable folding tongues 43 and 45.

OPERATION

Figure 4:
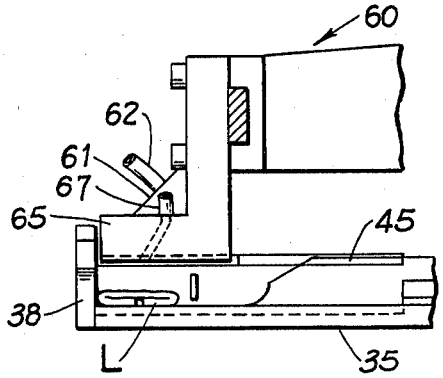
FIG. 4 is an end elevational view with the end stop removed of the apparatus of FIG. 3 in the initial position for receiving a belt loop.
Figure 5:
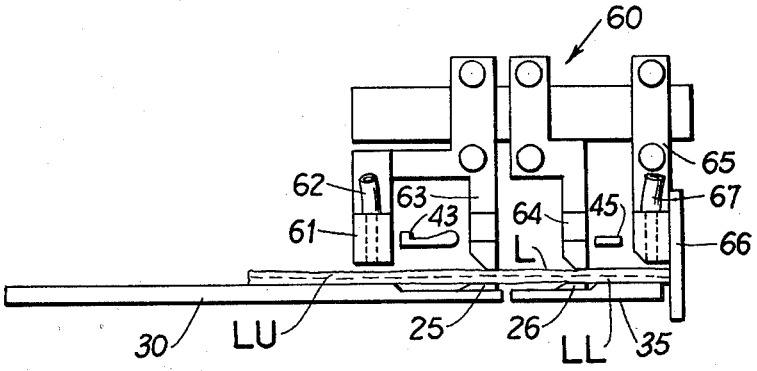
FIGS. 5, 6 and 7 are elevational views similar to FIG. 4 illustrating the apparatus in the stabilizer clamping position, the movable folding tongues in the dropped position, the movable folding tongues in the dropped position starting to fold the loop ends, and the movable folding tongues in a transitional position nearing completion of the loop folding operation, respectively.

Initially, the apparatus is in the position as shown in FIGS. 1, 3 and 4 wherein the main plate 20 is fully retracted by motor 11, drop plates 30 and 35 are biased to their uppermost position by springs 32 and 36 with the stationary folder tongues 25 and 26 disposed in recesses of plates 30 and 35, cam arm 40 and the corresponding cam arm (not shown) are spring biased outwardly away from one another with the movable folder tongues 43 and 45 spaced above and laterally outward from the stationary folder tongues 25 and 26, and the retracted motor 16 having moved the stabilizer assembly 60 downwardly to a position where the stop 17 engages the main or base plate 12 and the stabilizer fingers or jaws, 61, 63, 64 and 65 are spaced above the plates 30 and 35. A fluid stream delivers a belt loop L endwise into the belt loop receiver or in a lateral direction relative to the novel apparatus where the air jets from means 62 and 67 urge the loop L against front plates 34 and 38, and against the end stop 66. The stop motor 17 is then sequenced to collapse thereby permitting the motor 16 to further retract and lower the stabilizer assembly 60 to where the belt loop L is clamped between the stationary folder tongues 25 and 26, and stabilizer jaws 63 and 64 as shown in FIG. 5, and remains clamped in this manner until the stabilizer assembly 60 is elevated away from the folding apparatus immediately prior to presentation of a folded belt loop to a stitching position.

The motor 51 is now energized to move the cam assembly 50 forwardly initially causing roller cams 52 to engage cam block 31 and a corresponding cam block (not shown) causing drop plates 30 and 35 to move downwardly against the bias of springs 32 and 36 thereby moving the cam arms and movable folder tongues 43 and 45 to assume the lowered positions as shown in FIG. 6. Further forward movement of the cam assembly 50 causes roller cams 53 to engage and move cam arm 40 and the corresponding cam arm (not shown) to pivot against their spring bias towards one another causing the lowered movable folder tongues 43 and 45 to progressively move toward each other as shown in FIGS. 6 and 7 until they pass one another and reach a final position where the movable folder tongue 43 is now vertically aligned with the stationary folder tongue 26 as shown in FIG. 8.

The movement of tongue 45 folds the lower loop end LL under the stationary folder tongue 26 and the clamped portion of the belt loop L while movement of the tongue 43 folds the upper loop end LU under the stationary tongue 25, the folded lower loop end LL and past the fold of the lower loop end to provide an exposed flag or portion. In the final fold position, as shown in FIG. 8, the folded under lower loop end LL and upper loop end LU are clamped between the stationary tongue 26 and the movable tongue 43 to clamp the loop L in position.

The double acting axial fluid motor 16 is now energized to expand and acting through bell crank 15 and slide assembly 14 raises or retracts the stabilizer assembly 60 away from the loop folder and feed apparatus as shown in FIG. 2. The double acting axial fluid motor 11 is in turn energized to extend and move the main or base plate 20 with the associated fold and feed apparatus longitudinally or forwardly to a stitching station having a pair of jaws as indicated as A and B for receiving the folded belt loop L which moves transversely to its length. The jaws indicated as being A and B may be, for example, the jaws 24 and 27 of the U.S. Pat. No. 4,279,209.

By oppositely energizing motors 11, 16 and 51, the novel apparatus is returned to its initial position to receive a successive loop to be folded and fed.

Although only a single embodiment of the invention has been illustrated and described in detail, it is to be expressly understood that the invention is not limited thereto. Various changes may also be made in the design and arrangement of the parts without departing from the spirit and scope of the invention as the same will now be understood by those skilled in the art.

What is claimed is:

1. Apparatus for folding and presenting a drop type belt loop for attachment to a garment, comprising a base plate;

drop plate means connected to move vertically relative to said base plate and biased upwardly;

said drop plate means being provided with a laterally disposed receiver immediately forward of said base plate for belt loops moving endwise thereto;

folding means comprising a pair of laterally spaced stationary tongues connected to said base plate and extending across the bottom of said receiver, and a pair of folding tongues connected to said drop plate means and extending therefrom across said receiver;

said folding tongues being spaced upwardly and outwardly of said stationary tongues;

stabilizer means being provided with a pair of laterally spaced jaws extending across said receiver and being spaced vertically in alignment with said stationary tongues;

first means for moving said stabilizer means toward said receiver to clamp a belt loop during folding between said jaws and stationary tongues, and for moving said stabilizer means away from said receiver to release a folded belt loop;

second means for simultaneously moving said receiver and folding tongues downwardly relative to said stationary tongues and thereafter moving said folding tongues toward each other below said stationary tongues thereby folding the upper and lower loop ends under the belt loop between said stationary tongues with the upper loop end extending past the fold of the lower loop end;

one of said folding tongues being disposed in vertical alignment with one of said stationary tongues thereby clamping the folded loop ends therebetween; and means for moving the stationary and folding tongues forwardly thereby moving a folded belt loop transversely to its length to a stitching station of a tacker for attachment to a garment.

2. Apparatus in accordance with claim 1, and said stabilizer means being further provided with a pair of fingers extending across said receiver each being spaced laterally from a different one of said jaws;

a plate connected to one of said fingers closing the end of said receiver opposite from the end of said receiver through which the belt loops move; and at least one of said fingers having means for directing an air jet to impinge on and position a belt loop in said receiver.

3. Apparatus in accordance with claim 2, and said stabilizer means further comprising holding off means engaging said base plate for holding said jaws in vertical spaced alignment with said stationary tongues until a belt loop is disposed in said receiver; and said hold off means releasing said jaws for movement toward said stationary tongues after a loop is received.

4. Apparatus in accordance with claim 2, and further comprising a bearing block adapted for mounting in a predetermined position relative to a stitching station of a tacker; and means for moving said stationary and folder tongues comprising an axial motor means mounted on said bearing block and connected to said base plate for moving said base plate longitudinally toward a stitching station for presenting a folded belt loop thereat, and away from said stitching station after said belt loop has been presented.

5. Apparatus in accordance with claim 4, and said drop plate means comprising a pair of drop plates connected side by side to said base plate each having spring means biasing each plate upwardly toward said base plate;

a pair of cam arms each pivotally connected to a different one of said drop plates and spring biased away from the other of said arms; and said second means comprising cam means initially moving said drop plate downwardly against the bias of said springs and upon further movement urging said arms to pivot toward one another.

6. Apparatus in accordance with claim 5, and said folding tongues each being connected to a different one of said arms and being movable with said arm as said arms pivot; and said arms and folding tongues moving vertically in unison with said drop plates.

7. Apparatus for folding and presenting a drop type belt loop to a stitching station for attaching to a garment comprising means for receiving a belt loop moving endwise to said apparatus;

means for clamping the belt loop in a predetermined position;

means for folding the ends of the belt loop under the belt loop held by said clamping means so that the upper loop end extends past the fold of the lower loop end; and means for moving said folded belt loop transversely to its length to said stitching station.

8. A method of folding and presenting a drop type belt loop for attachment to a garment comprising the steps of feeding a belt loop endwise to a position for folding;

clamping the belt loop in position only until folded;

underfolding both ends of the belt loop with the underfolded upper belt loop end extending past the fold of the lower belt loop end;

clamping the underfolded belt loop ends together thereby holding the belt loop and moving the folded belt loop transversely to its length for presenting the folded belt loop for attachment.

9. The method in accordance with claim 8, and providing a receiver for a belt loop to be folded; and positioning the belt loop in the receiver.

10. The method in accordance with claim 9, and feeding the belt loop to the receiver by a fluid stream; and positioning the belt loop in the receiver with fluid jets impinging on the belt loop.

* * * * *